United States Patent [19]

Johnson

[11] 4,107,861

[45] Aug. 22, 1978

[54] LABEL STRUCTURE

[75] Inventor: Kenneth M. Johnson, Chicago, Ill.

[73] Assignee: Packaging Laminators, Inc., Bensenville, Ill.

[21] Appl. No.: 680,381

[22] Filed: Apr. 26, 1976

[51] Int. Cl.[2] ..... A44C 3/00

[52] U.S. Cl. ..... 40/2 R

[58] Field of Search ..... 40/130 K, 2 R, 135; 35/66

[56] References Cited

U.S. PATENT DOCUMENTS

| | | | |
|---|---|---|---|
| 2,648,924 | 8/1953 | Brewster | 40/2 R |
| 2,670,971 | 3/1954 | Johnson | 282/19 R |
| 2,917,838 | 12/1959 | Neugass | 40/130 K X |
| 2,979,840 | 4/1961 | Eastman | 40/2 R |
| 3,047,443 | 7/1962 | Anderson | 428/913 |
| 3,135,533 | 6/1964 | Short | 40/2 R X |
| 3,379,560 | 4/1968 | Tharp | 428/913 |
| 3,383,121 | 5/1968 | Singer | 282/28 R |
| 3,650,059 | 3/1972 | Johnson | 40/316 |
| 3,690,999 | 9/1972 | Setzer | 197/6.7 X |
| 3,961,112 | 6/1976 | Genevitz | 428/913 |

*Primary Examiner*—Louis G. Mancene
*Assistant Examiner*—Wenceslao J. Contreras
*Attorney, Agent, or Firm*—Hill, Gross, Simpson, Van Santen, Steadman, Chiara & Simpson

[57] ABSTRACT

A label structure wherein indicia marked therein by application of localized pressure are relatively permanent and are not generally altered by sunlight, water, temperature changes, mechanical handling, chemicals which do not attack the label structure, etc. The label structure comprises a panel member and fastening means with the panel member characteristically being formed by at least two flattened members, one of which is an oriented thermoplastic sheet or film.

23 Claims, 8 Drawing Figures

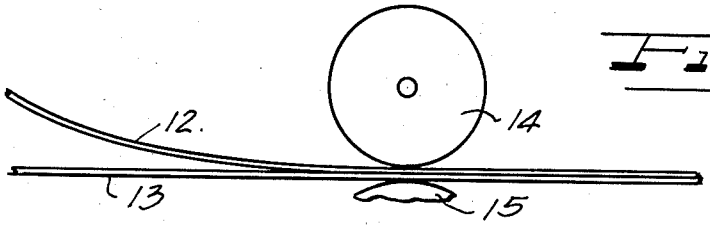
Fig. 1
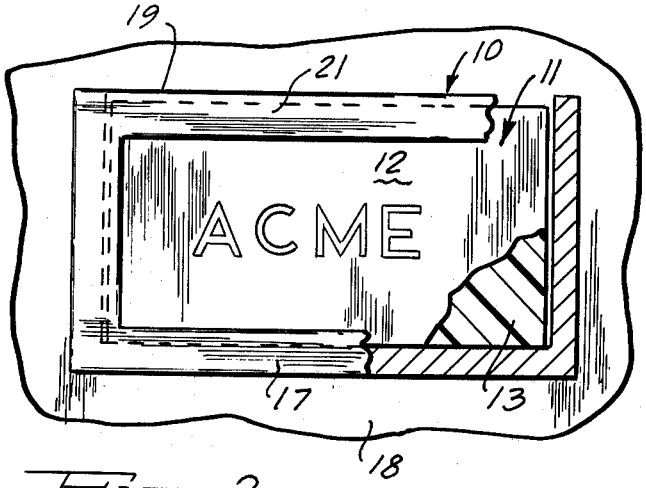
Fig. 2
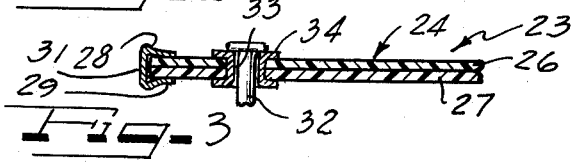
Fig. 3
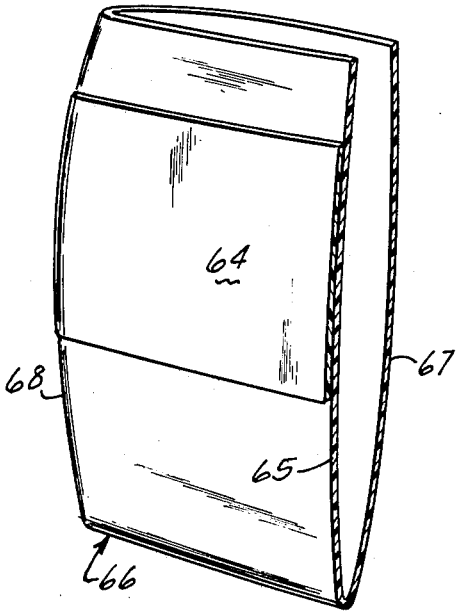
Fig. 8
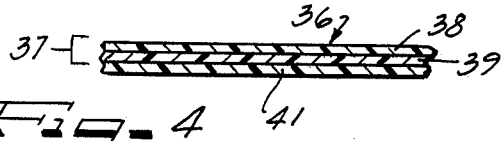
Fig. 4
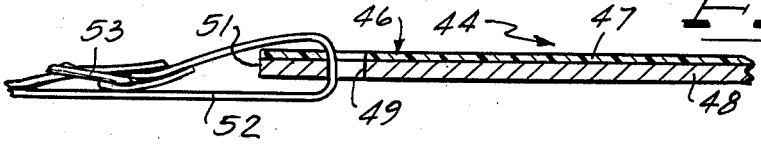
Fig. 5
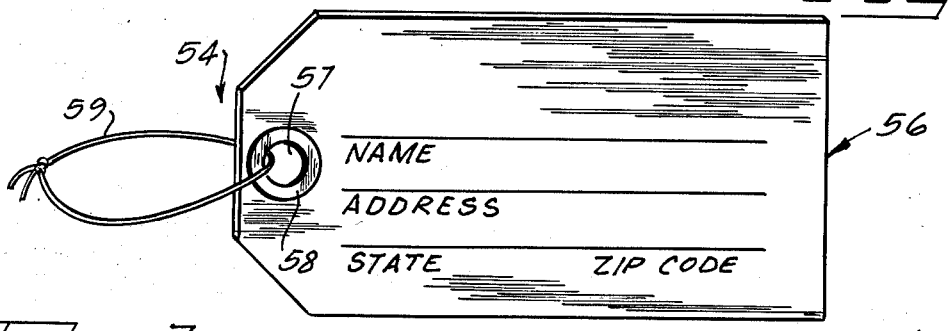
Fig. 6
Fig. 7
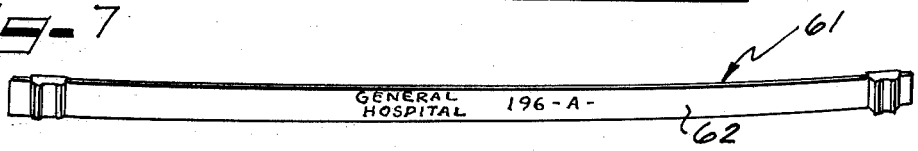

LABEL STRUCTURE

BACKGROUND OF THE INVENTION

In the art of labels, there is a well recognized and well-known problem of permanency. The problem is the fact that indicia placed upon a label structure tends to be relatively impermanent. For many areas of utility, labels need to be relatively permanent and not particularly adversely affected by sunlight, water, temperature changes, mechanical handling, or chemicals which do not attack the label itself, and the like.

Also, in the area of permanent labels, there is a need for label structures which are capable of having additional indicia placed thereon at some time after original indicia have been marked thereupon. Permanent type labels heretofore available in many instances do not permit one to readily add additional indicia which have a permanency equal to such original indicia.

It is also desirable for a label of the permanent type having the capacity to receive additional indicia thereon, as indicated, to be relatively tamperproof, such as to allow a viewer of the label to immediately detect any attempts to alter the original indicia.

BRIEF SUMMARY OF THE INVENTION

The present invention is directed to a label structure which overcomes the shortcomings indicated above and which provides an improved label structure in which inscribed indicia are relatively permanent and which label structure is not substantially adversely affected by such environmental and use factors as sunlight, water, temperature changes, mechanical handling, chemicals which do not actually attack the label structure, and the like over prolonged periods of time. Furthermore, the label structure of this invention enables one to inscribe additional permanent indicia on a label structure after it has once been marked with indicia and if desired, even after it has been applied to an object or body to be labeled. An additional feature of the label structures of the present invention lies in the fact that, so far as it is presently known, indicia once marked thereon cannot be removed by any known technique without leaving visible evidence of tampering, thereby making label structures of this invention relatively tamperproof.

Other objects, aims, purposes and advantages will be apparent to those skilled in the art from the present specification and accompanying drawings.

More particularly, a label structure of this invention incorporates a panel. The panel comprises a sheet member and a substrate member. The sheet member has generally spaced, parallel faces and a thickness in the range from about 0.1 to 100 mils and is comprised of an oriented thermoplastic polymer which is translucent or opaque in respect to transmitting daylight.

The substrate member of the panel has at least one generally smooth surface. Such surface is adjacent one face of the sheet member and is laminated thereto. In one preferred form, such a substrate member is in a sheet-like form.

The label structure also includes bonding means joining the sheet member and the substrate member in a fixed, adjacent relationship relative to one another. Furthermore, the label structure includes a fastening means which not only engage the panel but also adapts the panel for securing to a body spatially approximate to such label structure.

BRIEF DESCRIPTION OF THE DRAWINGS

FIG. 1 is a diagrammatic view illustrating one step in a process for making a label embodiment of the present invention;

FIG. 2 is a plan view of an embodiment of a label structure of the present invention, some parts thereof broken away and some parts thereof shown in section;

FIG. 3 is a partial, vertical sectional view of an alternative embodiment of a label structure of the present invention;

FIG. 4 is a view similar to FIG. 3 but showing another alternative embodiment of a label structure of the present invention;

FIG. 5 is a view similar to FIG. 3 but showing another alternative embodiment of a label structure of the present invention;

FIG. 6 is a view similar to FIG. 2 but showing another alternative embodiment of a label structure of the present invention;

FIG. 7 is a view similar to FIG. 6 but showing another alternative embodiment of a label structure of the present invention; and FIG. 8 is a perspective view of a further embodiment of a label structure of the present invention.

DETAILED DESCRIPTION OF THE DRAWINGS

Label structures of the present invention each employ characteristically a panel, as indicated above. For example, referring to FIG. 2, there is seen a panel 11 which is comprised of a sheet member 12 and a substrate member 13. The sheet member 12 has generally spaced parallel faces and ranges in thickness from about 0.1 to 100 mils. Sheet member 12 is comprised of an oriented thermoplastic polymer which is translucent or opaque as respects transmitted daylight. Preferably, the sheet member 12 is composed of a biaxially-oriented (e.g. bilaterally oriented) polymer, although monoaxially oriented polymers may also be used. Oriented thermoplastic polymers are well known to the art. Preferred orientated thermoplastic polymers for use in the practice of the present invention are selected from a group consisting of acrylic polymers, polyolefin polymers, polystyrene polymers, polyvinylchloride polymers, polyamide polymers, polyester polymers, including various copolymers thereof and similar thermoplastic material (and various rubber-modified polymers, thereof for example a high density rubber-modified polyethylene polymer, or the like), capable of being formed into orientated sheets or films. Thermoplastic elastomers as such, or blends thereof with any of the foregoing polymers or copolymers can be employed. Techniques for producing oriented thermoplastic polymer sheets and films are well known to the art and do not constitute, as such, any part of the present invention.

The substrate member 13 characteristically has at least one generally smooth surface and this surface is adjacent one face of the sheet member 12 as shown in this embodiment. Preferably, the substrate member 13 is itself in a sheet-like form, as shown which has any convenient thickness. In one mode, such as is illustrated by panel 11, the substrate member 13 is comprised of a sheet of colored thermoplastic polymer ranging from about 0.1 to 100 mils inch in thickness. Preferably, the substrate member is opaque, but, as those skilled in the art will appreciate, the substrate member may be translucent or even transparent. The substrate member 13 preferably has a contrasting color relative to the color of the sheet member 12 so as to increase the legibility of indicia on panel 11.

Preferably, a sheet member 12 is white or whitish in background areas (that is, areas not inscribed with indicia). In another alternative form, the sheet member 12 is opaque (that is, non-transmissive of daylight) in such areas not marked or inscribed with indicia.

As indicated, a panel of this invention includes bonding means for mounting a sheet member, such as sheet member 12, to a substrate member, such as substrate member 13, in fixed adjacent relationship relative to one another. For example, sheet member 12 and substrate member 13 may be directly laminated together. Thus, a sheet member 12 and a substrate member 13 may be continuously laminated together between a pair of laminating rollers 14 and 15, as illustrated in FIG. 1, using conventional laminating technology well known to those of ordinary skill in the art, employing heat and pressure only, so that a direct bonding action occurs between the sheet member 12 and the substrate member 13. Direct lamination between a sheet member 12 and a substrate member 13, particularly when the substrate member 13 is itself a sheet or film of thermoplastic polymer, represents a preferred form for preparing a panel of the type used in a label structure of the present invention.

Alternatively, a thin layer of an adhesive (not shown) preferably of a thermosetting type, may be interposed between a sheet member 12 and a substrate member 13 during lamination of these two members together to form a structure suitable for use as a panel in a label structure of this invention. Commonly, after a lamination operation, a laminate of sheet member and substrate member may be shaped, as by cutting, to form a panel of dimensions desired.

As indicated, a label structure can, such as illustrated in FIG. 2, incorporate fastening means engaging the panel for securing the panel to a body spatially proximate to the label member. For example, label structure 10 utilizes as a fastening means, a cardholder 17 of the conventional type employed on file drawers, file cabinets and the like. The cardholder 17, as those skilled in the art will appreciate, is characteristically of a unitary, one-piece construction formed of metal, plastic, or the like, and is usually mounted against a surface 18 which is to be labeled, such as when the surface 18 is part of a drawer of a file cabinet, file drawer, or the like. The cardholder 17 is adapted to be in face-to-face engagement with the surface 18 on three of its four sides, but to be open on a fourth side, such as side 19 in cardholder 17. Behind a flattened front face 21 of cardholder 17 across the top thereof there is provided a slot between surface 18 and a back portion of cardholder 17. This slot provides a region of access into cardholder 17 through which the panel 11 may be inserted. Once in position, the overlying portions of the flattened front face 21 of cardholder 17 provide flange members retaining the panel 11 in a desired position for viewing.

Shown fragmentarily in FIG. 3 is an alternative label structure 23. In structure 23, the panel 24 thereof is comprised of sheet member 26 and substrate member 27 which are similar to the respective sheet member 12 and the substrate member 13 employed in the panel 11. Here, sheet member 26 and substrate member 27 are equipped with a circumferentially extending clip member 28 which peripherally extends around the panel 24 and protects the edge of sheet member 26 and the edge of the substrate member 27, which are in laminated, face-to-face, bonded engagement with each other. The clip member 28 may include a base 31 and walls 29 extending therefrom into a securement position with a face of sheet member 26 and a face of substrate member 27, respectively. The label structure 23 is secured to a body by means of a rivet 32 (shown here in an unmounted position and configuration) which rivet 32 extends through an aperture 33 formed through the panel 24. The aperture 33 is provided with a grommet 34 to reinforce the edges of the aperture 33. Alternatively, in place of rivet 32, another fastening means may be used, such as a closed loop or the like (not shown). The label structure 23 may be used for securing a label to sheet metal or the like, as those skilled in the art will appreciate.

Referring to FIG. 4, there is seen an alternative label structure 36. Here the panel thereof is comprised of a sheet member 38 and a substrate member 39 which are laminated together in the manner described in FIG. 1 and which may be comprised of materials as indicated in reference to the label structure 10 of FIG. 2. The exposed face of substrate member 39 is provided with a fastening means, such as a layer 41 of an adhesive material, which is preferably pressure-sensitive, as those skilled in the art will appreciate. An adhesive layer 41 is conventionally applied to a substrate member 39 by a conventional coating operation, for example, using a liquid system. Upon exposure to heat, after coating (as is typical in a manufacturing operation), there results a solidified layer 41 of the desired adhesive material following the removal (as by evaporation) of any carrier liquid involved. The application and preparation of liquid systems for adhesive coating are well known to those in the art. An individual panel 37 of a label structure 36 may be in the form of a pre-formed geometric shape, or a panel member 37 may be in the form of a continuous strip of material which is cut by the user to an appropriate length desired for use in a particular in-use application, as from a convolutely wound roll or the like. As those skilled in the art will appreciate, the choice of a particular type of adhesive layer 41 in any given label structure 36 depends upon use or application contemplated.

Referring to FIG. 5, there is seen an alternative label structure 44 of this invention wherein the panel 46 thereof is comprised of an oriented film 47 of a thermoplastic material and wherein the substrate member 48 thereof is formed of a sheet of metal, such as aluminum or the like having a thickness ranging from about 0.1 to 150 mils. The sheet member 47 is heat laminated in this embodiment to the substrate member 48 directly, but a layer of an adhesive material intervening between the sheet member 47 and the substrate member 48 could be employed alternatively. An aperture 49 is formed in the label structure 44 adjacent an edge 51 thereof and a flattened strap member 52 is extended therethrough. The strap member 52 is preferably equipped with an adjustment means, such as a buckle 53 to provide adjustability in the size of the loop which can be formed with the flattened strap member 52, thereby to provide adjustability so that a label structure 44 may be used for mounting to a variety of materials such as, for example, luggage, brief cases, crates, and the like.

Referring to FIG. 6, there is seen an alternative form of label structure of this invention herein designated by the numeral 54. The label structure 54 can be regarded as having a panel 56 which is similarly constructed to panel 11 of the label structure 10 of FIG. 2 but here the panel 56 has been formed into the shape of a conventional tag and is provided with an aperture 57 through which is mounted an eyelet 58. Through aperture 57 is extended a length of wire or twine 59 to provide a fastening means. The sheet member portion of the panel 56 has imprinted thereon indicia, such imprinting being accomplished by a conventional printing means which can be of the type which merely deposits an ink composition upon the surface of the panel 56 and does not otherwise impress indicia in panel 56. Such an imprinting is accomplished through the use of insufficient pressure to make permanent indicia in panel 56 of the character provided in a label structure of this invention. One suitable printing device is a roller of the type associated with a lithographic press, or the like. With this type of label structure as illustrated at FIG. 6, the manufacture thereof might ink-imprint certain standard indicia on the panel 56 and the ultimate user thereof could then pressure-imprint specialized indicia, as with a non-ink stylus to complement the ink-imprinted indicia on panel 56.

In FIG. 7 a further alternative embodiment of a label structure of this invention is shown, herein designated in its entirety by the numeral 61. The label structure 61 is in the form of an identification device or band of the type adapted to provide positive associated identification of persons in hospitals or the like, such as a newborn baby or its mother. Such a device is shown, for example, in U.S. Pat. No. 3,027,665 from a structural standpoint, and a label structure 61 is distinctly different from that shown in this patent by reason of panel member 62 thereof being formed in accordance with the principles of the present invention. In label structure 61, the panel is constructed, for example, in the manner taught above in reference to label structure 10 and its panel 11, although any convenient panel structure of the present invention may be employed.

Shown in FIG. 8 is one further embodiment 66 of a label structure of the present invention. In embodiment 66, the sheet member 64 is heat laminated to a sheet-like substrate member 65 which forms the front face or panel of a plastic bag or container 68. The back face or panel 67 of the container 68 can be formed of a material similar to that used for the front panel 65. For example, the container 68 may have its front panel 65 and its back panel 67 formed of a pigmented polyvinylchloride sheet or film which has laminated thereto a bilaterally oriented sheet member 64 such as a film of polyethylene, polyester, polystyrene or the like. The sheet member 64 is adapted to be pressure-impressed with indicia in a manner characteristic of the label structures of the present invention.

Those skilled in the art will appreciate that a label structure of the present invention may be incorporated into, or form an integral part of, a wide variety of containers. Observe that in a container 68 or the like, the bonding means for securing a sheet member, such as 64, to a substrate member, such as 65, and the fastening means for engaging a panel to a body proximate thereto can be considered as being combined into a single means or function.

In order to mark indicia upon a label structure of this invention, such as label structure 10, 23, 36, 44, 54, 61 or 66, one applies a minimum pressure force to some object, preferably one with a relatively small surface area, which rests against the surface of the sheet member portion of the panel portion of such a label structure.

A suitable instrument for applying such force comprises, for example, a stylus, a typewriter key (operated by a typewriter), an embosser, a printing letter, press apparatus, or the like. When such a force is applied to such a label structure of this invention, a plurality of things appear to occur. For one thing, the material comprising the sheet member portion of the panel of the label structure is apparently made slightly more thin than the surrounding areas of the sheet member, so that more light or sufficient light is transmitted through the material to make the resulting material in the force-struck areas lighter in color and more translucent of daylight than surrounding (background) areas. For another thing, the surface of the sheet member to which the force is applied is apparently changed in a way not presently clear to provide a different molecular orientation at the pressure point or region in the sheet member involved. For still another thing, the surface characteristics of the sheet member in the force-struck areas, as a result of the application of such localized force thereto, are apparently altered so as to permit incident light to be more readily transmitted therethrough. When the localized pressure is applied to a sheet member, and the changes above indicated are apparently made in a sheet member, a contrasting color associated with a backing sheet or substrate member, and relative to a sheet member becomes visible through the sheet member (e.g. the sheet or film of oriented polymer). The exact mechanism by which indicia are formed through application of localized pressure is not understood, and there is no intent herein to be bound by any theory or by any explanation as provided above. The exact amount of pressure needed for forming a given character or mark in a particular label structure of this invention can vary and it is not possible or practical to give exact values for the amount of localized pressure which can be employed or should be employed for all possible embodiments of this invention, but the amount of presssure can be readily and simply ascertained by workers in the art. In any event, label structures of the invention are capable of having information recorded therein by impressing indicia onto a face of the sheet member without mechanical distortion of the label structure so as to record the indicia into the label structure permanently during a normal life cycle of such label structure by causing localized indicia-impressed areas of the sheet member to become more light-transmissive than unimpressed adjacent sheet member areas.

Indicia recorded through the application of localized pressure in a panel member of a label structure of the present invention are characteristically virtually unaffected by a variety of external environments such as sunlight, water, temperature changes, mechanical handling, chemicals which do not actually attack the plastic materials of the label structure and the like.

It is a further feature of the present invention that indicia-imparting pressure may be subsequently applied after the lapse of an indefinite period of time to a label structure of this invention so that additional indicia can be marked or placed on a label structure even after, for example, the label structure has been applied to or secured to an object and an extended period of time has elapsed. The particular end use to which a label structure of the present invention may be put is without any particular critical limitation; in general, all conventional label applications are suitable for utilization using label structures of the present invention.

As those skilled in the art will appreciate, in a label structure 36 (best seen at FIG. 4), having an adhesive layer 41 on the backside thereof, when the layer 41 is comprised of a pressure-sensitive material, a release sheet (not shown) may be employed to cover the pressure-sensitive material before the label structure 36 is used. The composition of the release sheet is dependent upon the particular type of adhesive film employed, but particularly common release sheets employ silicone coatings, polytetrafluoroethylene coatings, or the like, as those skilled in the art will appreciate. A label structure, such as label structure 36, may be used as a mailing label, if desired.

By placing a substrate member of a sharply contrasting color behind the sheet member in a given label structure, one can create a label structure having a maximum viewability for indicia formed therein by application of localized pressure.

The choice of substrate materials, adhesives (if used), and even sheet members, is dependent upon the particular application involved and other variables, as those skilled in the art will appreciate. For example, strength may be achieved by laminating a bilaterally oriented polystyrene film to a polyester film, whereas softness and flexibility may be achieved by laminating a polystyrene film to a polyethylene substrate. The upper layer or indicia carrying layer or sheet member of a label structure of this invention can be an oriented (monoaxially or biaxially) film which is selected to undergo changes in response to particular amounts of localized force applied to surface areas thereof. A particularly preferred film for use as an oriented sheet member comprises a bilaterally oriented high density polyethylene film. For instance, one embodiment of a medical identification band preferably consists of one layer of a film of bilaterally oriented polyethylene, one layer of a polyester film, and optionally, a third layer comprised of colored, low-density (non-oriented) polyethylene, all layers being laminated together. In order to achieve a coloration difference between a sheet member and a substrate member adjacent thereto, one may employ a clear film substrate with a layer of a colored adhesive material positioned therebetween. In general, when one uses colored adhesives, the results are the same as though one had used a colored substrate. In general also, it is preferred to select a substrate material for a given label structure of this invention after knowledge of the use application to which the label structure is to be put is at hand.

Substrate thicknesses may vary. Preferred ranges for thicknesses of substrate sheet materials fall in the range from about 1 to 7 mils. For example one may use thicknesses on the order of about 5 mils, when a vinyl substrate is employed, however, one may use thicknesses on the order of about 1 mil when a polyester film is employed. Preferably all substrate materials have a color which contrasts, as indicated, with that of a particular sheet member used. The substrate member may be a coated material applied onto a larger particular sheet member and not a self-supporting film or sheet member as such, and which may be applied as a liquid layer or the like, as desired. Such a coated material can itself be colored in a manner which contrasts with the color of the sheet member. A thin protective coating layer, such as of saran or cellulose material, can overcoat a particular sheet member if desired; and if such a layer is used it is preferably transparent. Non-oriented low density and high density polyethylene sheet materials are suitable substrate materials where container applications are involved. Suitable for lamination to such a polyolefin substrate member are such sheet members as bilaterally oriented polystyrenes and bilaterally oriented polycarbonates which tend to yield rigid label structures of this invention.

Other and further modifications, embodiments, and applications will be obvious to those skilled in the art from a reading of the present specification, drawings, and claims and no undue limitations are to be associated therewith.

EMBODIMENTS

Several examples of the present invention are described in detail below. These examples are included merely to aid in the understanding of the invention and variations may be made by one skilled in the art without departing from the spirit and scope of the invention.

EXAMPLE I

A series of specimen sheet members cut from a film of biaxially oriented, high-density polyethylene film are laminated one each with heat and pressure to various substrate members to form a plurality of panels each adapted for utilization in label structures of the present invention.

The laminating procedure employed in each lamination was as follows: The laminating apparatus comprises a photographic-type dry mount press with a pair of electrically heated platens adapted to form a horizontal flat press bed. Platen temperature is about 121° C. Lamination time for each panel is about 30 to 45 seconds.

The polyethylene film used has a thickness of about 3 mils inch and has excellent resistance against impact, puncture, swagging and tear propagation. The film is bright white, translucent (nearly opaque), odorless, inert, and non-toxic, and is comprised of materials approved by the Food and Drug Administration. The film contains an ultraviolet light absorber which enhances its resistance to outdoor exposure; however, excessive and extended amounts of ultraviolet will diminish its physical properties. The specific gravity is 0.83, the tensile strength is 8.000 psi., the elongation is 120%, the impact strength is 150 kg-cm, the puncture strength by the Beach Puncture test is about 55 kg-cm, the tear resistance in newtons is about 10. The chemical properties show a water vapor transmission rate of 0.25 grams per 100 sq. in. per 24 hours at 38° C. The $O_2$ oxygen permeability is 80 cc per 100 sq. in. per 24 hours per 1 atm. at 25° C. Maximum use temperature is about 105° C. while minimum use temperature is about −58° C. There appears to be no dimensional change at high relative humidities. The flammability characteristics are classified as slow burning.

Substitute details of the resulting label structures are provided in Table I below.

Each product panel is punched with a hole near one edge thereof and provided with a wire loop to complete preparation of a complete label structure of this invention.

With a non-ink stylus, each panel of each label structure is inscribed with indicia on its sheet member face. It is found that each sheet member is readily marked with indicia, and the resulting indicia are readily viewable and visible. In each instance, the sheet member background portions remain white while the indicia inscribed localized regions appear to have the color of the substrate member. In each instance, the resulting indicia appear to be permanent, and not to be appreciably affected by changes in temperature, pressure, detergent washing, strong alkali aqueous solutions (e.g. one Normal NaOH solution immersion for 2 minutes), strong acid solutions (e.g. one Normal HCl solution immersion for 2 minutes), sunlight (e.g. 2 weeks daily exposure independent of weather changes), and mechanical handling (e.g. flexing). Indeed, in the case of panels with metal substrates, the indicia remained fully legible even though the substrate was attacked by the alkali and/or the acid, as the case may be.

Each of the panels when inserted into a typewriter in the manner of a sheet of paper, was found to be inscribable with indicia by normal typewriter operating procedures.

TABLE 1

| Panel No. | Substrate Members (non-oriented sheet form) Chemical Composition* | Thickness (in mils) |
|---|---|---|
| 1 | polyethylene terephthalate ("polyester") | 1 |
| 2 | low density polyethylene | 3 |
| 3 | aluminum | 2 |
| 4 | polyvinyl chloride | 3 |

*the polyethylene is clear; the polyester is tinted; and the polyvinylchloride is pigmented.

EXAMPLE II

The procedure of Example I is repeated except that here, in place of the biaxially oriented, high-density polyethylene, there is employed as the sheet member, films of biaxially oriented polypropylene, polyvinyl chloride, and polystyrene, with substrate members comprised of various polymer materials or metallic foils. Details of the resulting structures are provided in Table II below. When each product panel is punched with a hole near one edge thereof and provided with a wire loop, marked with indicia, and evaluated for permanency, all in the manner indicated in Example I, it is found that the results in each case are generally equivalent to those of Example I and that the indicia are readily marked, and viewable, and are permanent.

TABLE II-A

| Panel No. | Sheet member (oriented) and/or rubber modified) biaxially Chemical Composition | Thickness |
|---|---|---|
| 1. | Acrylic | as required |
| 2. | Polyethylene & Copolymers | as required |
| 3. | Polypropylene | as required |
| 4. | Polystyrene | as required |
| 5. | Polyvinyl Chloride and Copolymers | as required |
| 6. | Nylon | as required |
| 7. | Polyester | as required |

TABLE II-B

| Panel No. | Substrate Member (non-oriented) Chemical Composition | Thickness |
|---|---|---|
| 1. | Metal sheeting | as required |
| 2. | Metal foils | as required |
| 3. | Polystyrene | as required |
| 4. | Acrylic | as required |

TABLE II-B-continued

| Panel No. | Substrate Member (non-oriented) Chemical Composition | Thickness |
|---|---|---|
| 5. | Polyethylene | as required |
| 6. | Polyester | as required |
| 7. | Nylon | as required |
| 8. | Polypropylene | as required |
| 9. | Polycarbonate | as required |
| 10. | Urethanes | as required |

EXAMPLE III

The procedure of Examples I and II is repeated, except that here the substrate member comprises a preformed laminate comprised of a clear film of non-oriented polyethylene terephthalate about 1 mil thick, and a film of non-oriented low density polyethylene about 2 mils thick which is colored. The product panel is suitable for use in the manufacture of a medical identification band, such as one of the type shown and described in U.S. Pat. No. 3,027,665. The product panel is readily inscribed with indicia which are highly visible and permanent. The product panel was secured about the wrist of a number of individuals and allowed to remain thereon for about 30 days as such individuals conducted their normal lives, i.e., showering, bathing, passing through various changing ambient environments, etc. At the end of the test period no changes in the indicia on the various identification bands is visible.

EXAMPLE IV

Specimens of the biaxially oriented high density polyethylene film of Example I are coated on one face with a liquid adhesive composition and then applied to the same substrate members identified in Table I. The liquid adhesive solution comprised either a pressure sensitive acrylic adhesive, for example such as commercially available under the trade designation "Monsanto RA-788" (an acrylic based adhesive material, typically applied as about a 30% solids mixture in a solvent, such as methyl-ethyl-ketone) or a pressure-sensitive polyester adhesive material, for example such as commercially available under the trade designation "Dupont 46960" (a polyester based adhesive, typically applied as a 30% solids mixture in a solvent, such as methyl-ethyl-ketone). The adhesive layer in the product panel is estimated to be about 0.1 mils in thickness. The product panel in each instance is readily inscribed with indicia which are highly visible and permanent.

EXAMPLE V

The procedure of the immediately preceding Example IV is repeated, except that here about 20% of a red pigment is added to the adhesive composition, and applied to the substrates identified in Example IV. The product panel in each instance is readily inscribed with indicia which are highly visible and permanent.

EXAMPLE VI

A solution of about 30% of a polyester adhesive such as "Dupont 46960" mentioned earlier, in methyl ethyl ketone is prepared to which is added about 10% of a black pigment (100 weight percent total composition basis). The solution is coated on one face of a specimen of the oriented polyethylene film of Example I and dried in air at room temperature. The resulting layer is estimated to be about 0.3 mils, dry thickness.

The resultant product panel is readily inscribed with indicia, which are highly visible and permanent. The panel is useful in making flexible label structures of this invention.

I claim as my invention:

1. A label structure comprising a sheet member having generally spaced parallel faces said sheet member having, a thickness ranging from about 0.1 to 100 mils and comprised of an oriented thermoplastic polymer which is translucent as respects transmitted daylight, a substrate member in a sheet-like form having a generally smooth surface, said surface being adjacent one face of said sheet member, bonding means joining said sheet member and said substrate member together in fixed adjacent relationship relative to one another, at least one of said substrate member, and said bonding means having a contrasting color relative to said sheet member, and fastening means engaging said label structure for securing said label structure to a body spatially proximate to said label structure;

said label structure being capable of having information recorded therein by impressing indicia onto a face of said sheet member without mechanical distortion of said label structure so as to record said indicia into said label structure permanently during a normal life cycle of said label structure by causing localized indicia-impressed areas of said sheet member to become more light-transmissive than unimpressed adjacent sheet member areas.

2. The label structure of claim 1 wherein said bonding means comprises a direct lamination between said sheet member and said substrate member.

3. The label structure of claim 1 wherein said sheet member comprises a bilaterally oriented thermoplastic polymer selected from the group consisting of acrylic polymers, polyolefin polymers, polystyrene polymers, polyvinylchloride polymers, polyamide polymers, and polyester polymers.

4. The label structure of claim 1 wherein said substrate member comprises a sheet of colored thermoplastic polymer ranging from about 0.1 to 100 mils in thickness.

5. The label structure of claim 1 wherein said substrate member comprises a sheet of metal ranging from about 0.1 to 150 mils in thickness.

6. The label structure of claim 1 wherein said bonding means comprises a layer of adhesive.

7. The label structure of claim 1 wherein said fastening means comprises an adhesive layer secured to said substrate member.

8. The label structure of claim 7 wherein said adhesive layer is pressure-sensitive.

9. A label structure of claim 1 incorporated into a hospital identification bracelet.

10. A label structure of claim 1 incorporated into a tag.

11. The label structure of claim 1 wherein said substrate member is translucent.

12. The label structure of claim 1 wherein said substrate member is opaque.

13. A label structure of claim 1 incorporated into a tape.

14. A label structure comprising a sheet member having generally spaced parallel faces, a thickness ranging from about 0.1 to 100 mils and comprised of an oriented thermoplastic polymer which is opaque as respects transmitted daylight, a substrate member in a sheet-like form having a generally smooth surface, said surface being adjacent one face of said sheet member, bonding means joining said sheet member and said substrate member together in fixed adjacent relationship relative to one another, at least one of said substrate member and said bonding means having a contrasting color relative to said sheet member, and fastening means engaging said label structure for securing said label structure to a body spatially proximate to said label structure;

said label structure being capable of having information recorded therein by impressing indicia onto a face of said sheet member without mechanical distortion of said label structure so as to record said indicia into said label structure permanently during a normal life cycle of said label structure by causing localized indicia-impressed areas of said sheet member to become more light-transmissive than unimpressed adjacent sheet member areas.

15. The label structure of claim 14 wherein said bonding means comprises a direct lamination between said sheet member and said substrate member.

16. The label structure of claim 14 wherein said bonding means comprises a layer of adhesive.

17. The label structure of claim 14 wherein said sheet member comprises a bilaterally oriented thermoplastic polymer selected from the group consisting of acrylic polymers, polyolefin polymers, polystyrene polymers, polyvinyl chloride polymers, polyamide polymers, and polyester polymers.

18. The label structure of claim 14 wherein said substrate member comprises a sheet of colored thermoplastic polymer ranging from about 0.1 to 100 mils in thickness.

19. The label structure of claim 14 wherein said substrate structure comprises a sheet of metal ranging from about 0.1 to 150 mils in thickness.

20. A label structure of claim 14 incorporated into a hospital identification bracelet.

21. A label structure of claim 14 incorporated into a tag.

22. A label structure of claim 14 incorporated into a tape.

23. The label structure of claim 14 wherein said fastening means comprises an adhesive layer secured to said substrate member.

* * * * *